US007137225B2

(12) United States Patent
Zuppan

(10) Patent No.: US 7,137,225 B2
(45) Date of Patent: Nov. 21, 2006

(54) FOUNDATION WALL SYSTEM

(76) Inventor: David Zuppan, 3075 Malibu Dr., Warren, OH (US) 44481

( * ) Notice: Subject to any disclaimer, the term of this patent is extended or adjusted under 35 U.S.C. 154(b) by 35 days.

(21) Appl. No.: 10/179,106

(22) Filed: Jun. 25, 2002

(65) Prior Publication Data

US 2003/0233808 A1 Dec. 25, 2003

(51) Int. Cl.
*E02D 19/00* (2006.01)
*E04B 1/64* (2006.01)

(52) U.S. Cl. ..... 52/169.14; 52/294; 52/169.5

(58) Field of Classification Search ..... 52/900, 52/169.5, 302.3, 483.1, 481.1, 794.1, 797.1, 52/800.1, 309.9, 309.15, 63, 274, 293.3, 52/784.1, 169.14, 169.11; 428/74, 76
See application file for complete search history.

(56) References Cited

U.S. PATENT DOCUMENTS

| | | | | |
|---|---|---|---|---|
| 2,896,271 | A * | 7/1959 | Kloote et al. | 52/63 |
| 3,282,615 | A * | 11/1966 | Darby et al. | 52/783.18 |
| 3,526,031 | A * | 9/1970 | Truitt | 228/181 |
| 3,725,185 | A * | 4/1973 | Curtis | 442/27 |
| 3,736,715 | A * | 6/1973 | Krumwiede | 52/309.11 |
| 4,242,406 | A * | 12/1980 | El Bouhnini et al. | 442/373 |
| 4,263,762 | A * | 4/1981 | Reed | 52/293.3 |
| 4,574,099 | A * | 3/1986 | Nixon | 428/68 |
| 4,856,939 | A | 8/1989 | Hilfiker | |
| 4,864,789 | A * | 9/1989 | Thorn | 52/309.9 |
| 4,907,386 | A * | 3/1990 | Ekroth | 52/169.14 |
| 4,943,185 | A * | 7/1990 | McGuckin et al. | 405/45 |
| 4,956,951 | A * | 9/1990 | Kannankeril | 52/169.5 |
| 5,398,471 | A * | 3/1995 | Spagnolo | 52/412 |
| 5,535,556 | A * | 7/1996 | Hughes, Jr. | 52/169.5 |
| 5,792,529 | A * | 8/1998 | May | 428/36.2 |
| 5,845,456 | A * | 12/1998 | Read | 52/741.11 |
| 5,857,297 | A * | 1/1999 | Sawyer | 52/169.5 |
| 5,890,334 | A * | 4/1999 | Hughes, Jr. | 52/299 |
| 6,006,481 | A * | 12/1999 | Jacobs | 52/309.9 |
| 6,041,561 | A | 3/2000 | LeBlang | |
| 6,056,479 | A | 5/2000 | Stevenson et al. | |
| 6,205,720 | B1 * | 3/2001 | Wolfrum | 52/169.12 |
| 6,354,050 | B1 * | 3/2002 | Pankoski | 52/293.3 |
| 6,446,305 | B1 * | 9/2002 | Kneeland | 16/82 |
| 6,484,460 | B1 * | 11/2002 | VanHaitsma | 52/293.1 |
| 6,523,324 | B1 * | 2/2003 | Porter | 52/794.1 |
| 6,622,452 | B1 * | 9/2003 | Alvaro | 52/742.14 |
| 6,649,264 | B1 * | 11/2003 | Vodermayer | 428/392 |
| 6,694,702 | B1 * | 2/2004 | Weymer et al. | 52/784.1 |
| 6,698,157 | B1 * | 3/2004 | Porter | 52/794.1 |
| 6,854,228 | B1 * | 2/2005 | Arseneau et al. | 52/309.9 |
| 2002/0108337 | A1 * | 8/2002 | Clarke et al. | 52/309.9 |
| 2002/0164447 | A1 * | 11/2002 | Asgian | 428/40.1 |
| 2004/0177576 | A1 * | 9/2004 | Hughes, Jr. | 52/294 |

* cited by examiner

*Primary Examiner*—Robert Canfield
(74) *Attorney, Agent, or Firm*—Tarolli,Sundheim,Covell&Tummino LLP

(57) ABSTRACT

A wall system uses panels constituted by a sandwich of two polyolefin sheets and an interior layer of glass fiberboard. Such structural panels are used with a system of steel studs and channels to form walls of high strength and light weight. These walls are particularly suitable for foundations and basements, and exhibits strength, water resistance, and insulating values far in excess of those of conventional foundation walls.

17 Claims, 2 Drawing Sheets

FIG. 1
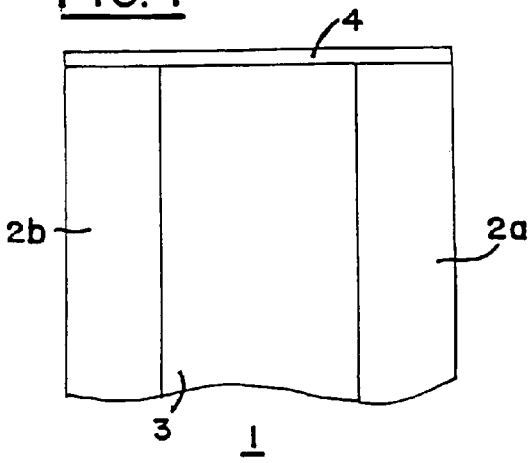
FIG. 2
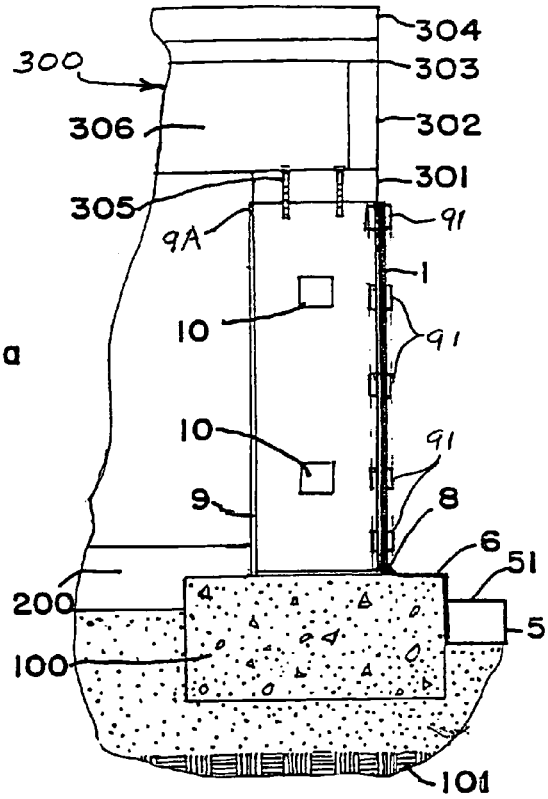
FIG. 3A
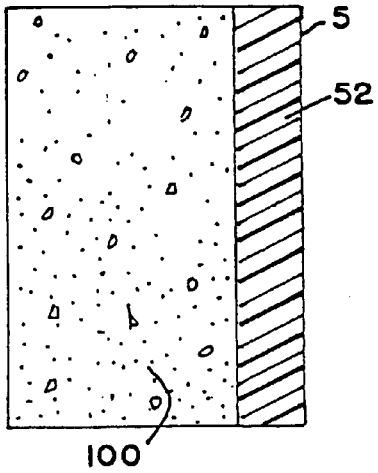
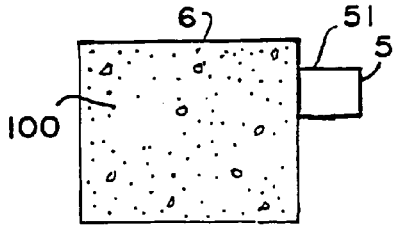
FIG. 3B

FIG. 4
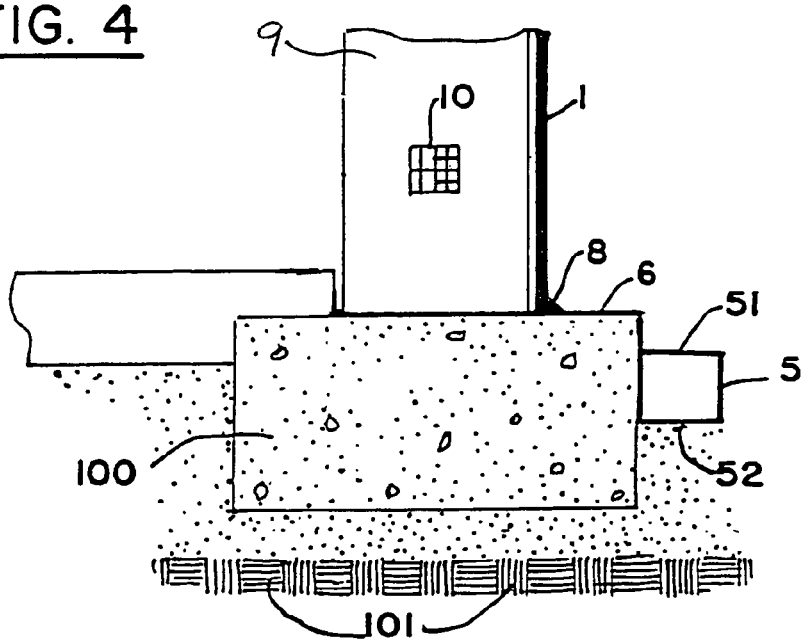
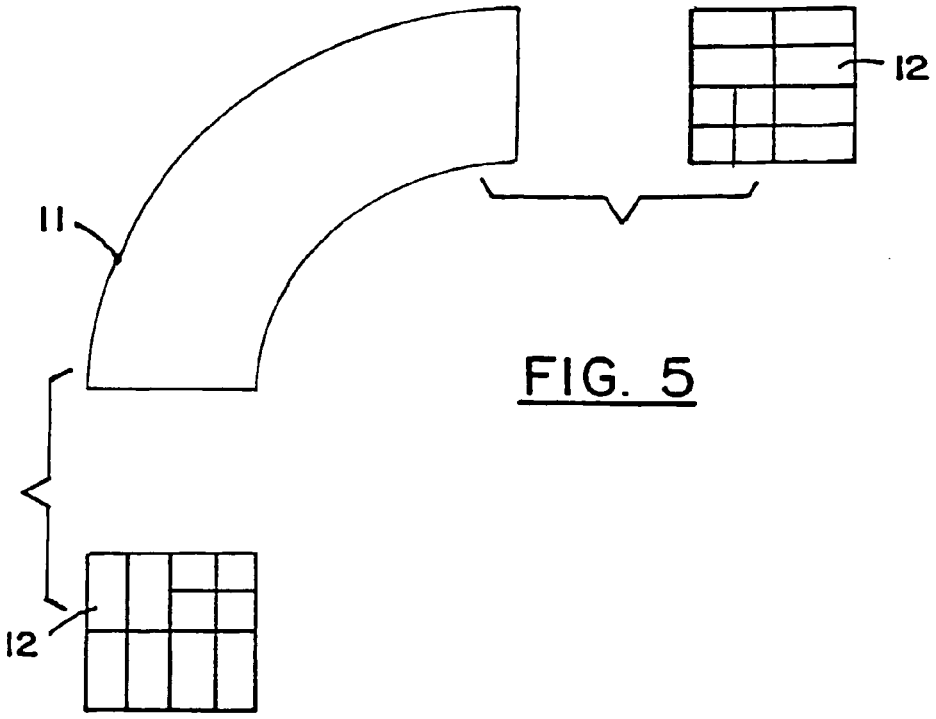
FIG. 5

FOUNDATION WALL SYSTEM

TECHNICAL FIELD

The present invention relates generally to the field of construction panels for walls and other structures. In particular, the present invention is directed to a wall panel system that is suitable for a wide variety of applications where structural strength, moisture resistance, and insulation values are especially important. Examples of such applications are foundation walls and basement walls.

BACKGROUND ART

One of the most demanding applications for building materials is use in foundation or basement walls. Such walls structures are subject to the weight of the building (weight tangential to the surface of the wall, or shear forces), as well as the weight of the surrounding ground, which exerts forces normal to the wall or wall panels. Besides the structural demands, such walls and the materials constituting them must be reasonably water-resistant, and preferably have a reasonably high insulating value (R value).

Standard residential and light commercial foundations are made of concrete-based products in a variety of different forms and embodiments. One embodiment is manufactured on the building site in the form of poured concrete. Another popular variation is pre-shaped and furnace-fired blocks (commonly called cinder blocks), which are manufactured at a factory and sent to a building site to be assembled using mortar and other well-known techniques. Foundation walls of this nature have been used since ancient times. These types of structures have had wide acceptance, and have enjoyed apparent success in a number of variations and embodiments. Some examples are described below.

One variation of a foundation wall is found in U.S. Pat. No. 4,856,939 to Hilfiker, issued Aug. 15, 1989 and incorporated herein by reference. In this patent, a retaining wall, to withstand a mass of earth, relies on polymer geogrids for reinforcement and wire trays to provide a solid face against the adjacent earth, which is to be held in place. The wire trays are L-shaped with intersecting floor and face sections. Hooked extensions formed on the face sections serve to secure the trays in a superimposed relationship to hold the geogrids in place against the trays. The geogrids extend distally from the trays to provide deep reinforcement. While the necessary structural strength is obtained to form a proper retaining wall, the techniques and materials are not appropriate for a foundation wall, as used in a dwelling, also the retaining wall of Hilfiker, cannot maintain the integrity of a structure or building resting on that wall. Nor is the retaining wall of Hilfiker appropriate for preventing the migration of moisture, or maintaining a reasonable R factor.

The structural integrity to withstand the normal stresses incurring for a foundation wall or retaining wall is provided by open-mesh structural textiles in U.S. Pat. No. 6,056,479 to Stevenson, et al., incorporated herein by reference. A structural textile is formed from at least two and preferably three components. The first component or load-bearing member is a high tenacity, high modulus, and low elongation yarn. The yarn can be either monofilament or multifilament. The second component is a polymer in the form of a yarn or other form, which will encapsulate and bond yarn at the junctions to strengthen the junctions. The third component is an optional effect or bulking yarn. In the woven structural textile, a plurality of warp yarns are woven with a plurality of weft (filling) yarns. The weave is preferably a half-crossed or full-crossed leno weave. The high structural integrity is provided in a wide variety of different shapes and applications and can withstand high normal stresses. However, open mesh structural textile is not suitable as a foundation wall material since substantial support for the structural textile is still required. Further, there is no moisture integrity or R factor provided by the structural textile.

Overall structural integrity apparently appropriate for a foundation wall is provided by the system of U.S. Pat. No. 6,041,561 to LeBlang, issued Mar. 28, 2000, and incorporated herein by reference. This system relies upon prefabricated, self-contained building panels, including a panel incorporating a truss structure as a part thereof. The panels include a skeletal assembly generally comprising an array of structural steel channels, rigid sheeting arranged proximate to the channels, and support members adjacent the rigid sheeting. The channels are supported between suitable base plates. The structure further includes angles for defining portions of the skeletal assembly and a forming structure, which is used as part of the skeletal assembly. The skeletal assembly and forming structure are oriented horizontally on a plane or surface. A self-hardening material, such as concrete, clay, or the like, is introduced to the forming structure for the embedding at least a portion of the skeletal assembly. The forming structure becomes an intrical part of the completed building panel, and is not removed therefrom. A building truss, including a pair of double-angle struts and a web-reinforcement bar threaded therealong, and rigid sheeting are arranged to define a receiving chamber for the self-hardening material.

The self-contained building panels can be made entirely at a factory for shipment in large segments to building sites, or the panels can be formed by pouring the concrete into the appropriate portions of the panels at the building site. It should be noted that large wall segments that are formed entirely at the factory are problematical due to the weight of the concrete. Using an alternative method of pouring the concrete at the building site introduces problems of quality control and uniformity. Further, the LeBlang system appears to be entirely subjected to the limitations imposed by the characteristics of concrete.

There are a number of limitations to poured concrete or cinder block foundation walls. Despite its strength in compression, cinder block and even poured concrete walls fail due to constantly changing load factors brought on from drastic temperature changes (in conjunction with water migration into the wall material), water-saturated soil, soil shifting, and shock waves from external disruptions transmitted through the ground to the foundation wall. One source of shock waves is earthquakes. Other examples would include explosive forces (both deliberate and accidental), as well as massive shifts in nearby ground structure due to clumsy construction techniques. Soil is essentially a slow-moving fluid, which is always shifting. As a result, there are constantly changing forces working on any foundation wall.

Concrete and cinder block walls that are inundated by water are seldom able to resist the penetration of moisture. Moisture migration introduces the possibility of toxic mold occurring in residential buildings. This becomes a critical factor in obtaining insurance coverage, which is often denied for residential structures having moldy interiors Further, if the water remains standing around the wall, and freezes, structural failure certainly occurs. As a further complication, concrete has uneven drying characteristics. This results in varying strengths throughout a poured concrete wall.

The molecular consistency of concrete is coarse. As a result, concrete has very little insulating value. Further, concrete absorbs, retains and wicks water to the interior of the structure that includes the foundation wall. This tendency is even more pronounced with cinder block. Just as moisture vapor can penetrate a concrete wall, so does Radon gas. This is particularly problematical in certain areas of Radon occurrence. A sufficient number of high Radon areas exist so that Radon has become the second leading cause of cancer in the United States. This factor becomes particularly critical in basements used as exercise rooms since heavy breathing increases the likelihood of Radon intake.

Poured concrete for building foundation walls is expensive, complicated, and time-consuming. Less expensive alternatives, such as cinder blocks, are widespread. However, the use of cinder block has its limitations. For example, skilled masons are necessary to erect any structure using cinder block, and additional treatment of the wall (such as filling the holes in the blocks) are often necessary to provide minimum standards of insulation, structural strength, and resistance to moisture migration. Further, because mortar is used throughout a cinder block wall, the wall loses flexibility that might have been provided by the use of multiple pieces as opposed to solid slab of concrete.

Both types of foundation wall fracture under a variety of loads that may introduce tensile stress at various points along the wall. Further, the fact that poured concrete foundations and cinder block foundation walls are fabricated at the building site by individuals of varying degrees of skill results in non-uniformity of structure, and higher rates of failure than would result from uniformly manufactured building panels subject to the quality control standards of a factory.

Another drawback of concrete foundation walls is its very low insulation capability or R factor, usually in the range of 1.4 to 3.0. Consequently, additional insulation must be added to foundation walls. This is expensive, complex, and time-consuming.

Even more detrimental is the damage to wooden structures supported by such foundation walls. The passage of moisture through concrete foundation walls dissipates through the rest of the structure, degrading wooden structural parts. The moisture can attack conventional structures in a number of ways, including: expansion damage in buildings in locations, which are subject to freezing temperatures; opening paths for insects; introducing mold problems; increasing the possibility of Radon gas occurrence; and, degrading thermal insulation.

As a result of some of the aforementioned problems, many modern wooden structures have severely limited usable lifetimes. Accordingly, framed structures on concrete or cinder block foundations have to be replaced relatively frequently.

A superior foundation wall system would eliminate all of the aforementioned disadvantages of conventional foundation wall systems, and would extend the lifetimes of the structures placed on those foundation walls. A desirable, improved foundation wall system would provide far greater tensile strength (and thus overall strength) than conventional poured concrete or cinder block walls, as well as providing a good R factor and impermeability to moisture. Preferably, the improved foundation wall system would have a much greater capability to withstand earthquake forces than conventional foundation wall systems.

SUMMARY OF INVENTION

It is a first object of the present invention to overcome the drawbacks of conventional foundation or basement wall systems.

It is another object of the present invention to provide a foundation wall system that is substantially impermeable to the migration of moisture.

It is a further object of the present invention to provide a foundation wall system that is substantially impermeable to gasses, in particular Radon.

It is an additional object of the present invention to provide a foundation wall system that is capable of withstanding substantial tensile stress, at a level that would destroy conventional concrete or masonry walls.

It is still another object of the present invention to provide a foundation wall system that can withstand both high sheer and normal stresses without failure.

It is yet a further object of the present invention to provide a foundation wall system capable of effectively flexing while remaining highly resistant to any kind of penetration.

It is again an additional object of the present invention to provide a foundation wall having a virtually unlimited longevity, and capable of adding to the longevity of any structure supported by the subject foundation wall.

It is yet another object of the present invention to provide a foundation wall having high insulating (R factors) as part of its constituent materials without the necessity of adding extensive insulation to the foundation wall.

It is again a further object of the present invention to provide a foundation wall system which readily admits to modification so that it can be adapted to have a much higher insulating value than in its original state.

It is yet an additional object of the present invention to provide a foundation wall system that is virtually invulnerable to cracking or permanent warping.

It is still a further object of the present invention to provide a foundation wall that is highly earthquake or explosion resistant.

It is still an additional object of the present invention to provide a foundation wall system that is relatively attractive when exposed above ground.

It is yet another object of the present invention to provide a foundation wall system that is relatively light in weight (when compared to similar masonry wall systems), so that large segments can be easily transported and assembled.

It is still a further object of the present invention to provide a foundation wall system that is easily manufactured in large segments away from the construction site where the foundation wall is being installed.

It is again another object of the present invention to provide a foundation wall system that is relatively easy to install, requiring little skilled labor.

It is yet a further object of the present invention to provide a foundation wall system that is relatively inexpensive.

It is again another object of the present invention to provide a foundation wall system that can be assembled very quickly in comparison to conventional masonry wall systems.

It is still a further object of the present invention to provide a foundation wall system with an integrated drainage mechanism that requires no further installation work once the foundation wall is installed.

It is yet another object of the present invention to provide a foundation wall system with a drainage devise that is configured for easy attachment between foundation wall segments.

It is still an additional object of the present invention to provide a foundation wall system with a drainage mechanism that is uniform along the entire length of the foundation wall.

It is again another object of the present invention to provide a foundation wall system with a drainage device that prevents pooling or accumulation of moisture anywhere along the length of the foundation wall system.

It is yet a further object of the present invention to provide a foundation wall system with an integral conduit system for conducting wires, fiber optics, and the like.

It is again another object of the present invention to provide a foundation wall system with an integral conduit system, which is adjustable to a variety of configurations for containing and separating wires, fiber optics, and the like.

It is still a further object of the present invention to provide a foundation wall system with an integral conduit system through which cables can be easily pulled.

It is yet another object of the present invention to provide a wall system having an integral conduit system that can be arranged at a variety of locations on the wall system.

It is again a further object of the present invention to provide a wall system having an integral conduit which is easily adaptable to a number of different corner configurations in the wall system.

It is still a further object of the present invention to provide retrofitting techniques to improve existing walls.

It is again another object of the present invention to provide an integrated foundation wall system that can accommodate temperature-induced creepage without permanent deformation.

These and other objects and goals of the present invention are accomplished by a first embodiment, including a system of at least one polyolefin structural panel arranged to connect at least partially to a support for an overlying structure.

Another aspect of the present invention includes a foundation wall system having a rigid barrier arranged to stop moisture migration through the foundation wall system.

A further aspect of the present invention is manifested by a foundation wall system having a rigid barrier for stopping Radon gas migration through the foundation wall system.

An additional aspect of the present invention is manifested by a structural panel, including two layers of polyolefin on either side of a glass fiber layer.

Yet a further aspect of the present invention is manifested by a foundation wall system including at least one structural panel having three layers bonded together by plastic along a periphery of the structural panel. The structural panel is connected to a framework.

Another aspect of the present invention is a drainage system for use with a foundation wall which is arranged on a footer. The drainage system includes a substantially rectangular channel and a plastic membrane attached to the channel and arranged to fit over the footer.

Still another aspect of the present invention is found in a conduit system for a framework wall. The conduit system includes at least one straight plastic channel and at least one curved plastic channel.

BRIEF DESCRIPTION OF DRAWINGS

FIG. 1 is a side cross-sectional view of the structural panel of the present invention.

FIG. 2 is a side cross-sectional view of the inventive wall system using the panel of FIG. 1.

FIG. 3A is a bottom view of FIG. 2.

FIG. 3B is a side-cross-sectional view depicting details of FIG. 2.

FIG. 4 is a side-cross-sectional view of FIG. 2, depicting additional details.

FIG. 5 is an exploded diagram of a corner section of the inventive conduit system incorporated into the inventive wall system.

DETAILED DESCRIPTION OF PREFERRED EMBODIMENTS

The most basic aspect of the present invention is the use of a plastic panel as a structural panel, such as those used to constitute foundation walls. Such walls, as described supra, must be capable of withstanding contact with the earth around the structure while still supporting that structure. Consequently, foundation walls are subject to both shear forces (from the weight above) and normal forces (from the weight of the earth against the wall). In the present invention, extruded Polyolefin sheets, such as those described in Appendix C attached hereto, used to construct foundation walls that support overlying structures, withstand the weight of the earth, and prevent moisture migration through the foundation.

One particularly useful aspect of the present invention is that the extruded polyolefin panels can be retrofitted to existing masonry walls, provide waterproofing, resistance to impact, and higher insulation value. A number of different methods can be used to connect polyolefin panels to existing masonry walls, including adhesives, plastic welding to other plastic structures on the existing wall, and the use of through-connectors. The holes made in the polyolefin panels by these connectors are easily sealed by the use of plastic welding.

Extruded polyolefin sheets can also be used along existing wooden walls, to provide higher insulation value, impact resistance, and to help support any other structures supported by the existing wooden wall. While any number of polyolefin materials can be used for such structural panels, the material considered most desirable as part of the present invention is Paxon™, as described in Appendix C, attached hereto.

As indicated by the calculations in Appendix A, an extruded sheet of Paxon™ (from ¼ inch to 1 inch), is a superior structural material for use in structural panels in foundation walls and the like. Using only the basic test results for small pieces of Paxon™, calculations for large extruded sheets, such as those that would be used in structural applications, have been developed as the preliminary work for the present invention. Calculations indicate that the strength of the sheets is far greater than that of much larger masses of poured concrete or cinder block. While the strength of Paxon™ is already well known, there has not been any consideration for using extruded Paxon™ panels as a structural element in foundation walls and the like. Calculations included in Appendix A, are not part of the published literature on Paxon™, but are provided as part of the discovery of the novel aspects of the present invention.

Another preferred aspect of the present invention is a structural panel constituted by three layers. The two outer layers are polyolefin sheets (high density, high molecular weight polyolefin) with a center layer constituted by glass fiberboard. This sandwich arrangement for the structural board 1 is depicted in FIG. 1. Layer 3 of glass fiberboard is sandwiched between layers 2*a* and 2*b* of polyolefin sheets. The periphery of the panel is preferably sealed by a plastic layer 4 which can be applied by standard plastic thermal-welding techniques. These structural panes can be used in a variety of different applications, and in particular, foundation or basement wall systems. A wall made with the structural panel sandwich 1 is far superior in many respects to conventional poured concrete, or other masonry walls.

Such structural panels 1 are extremely hard (due to the characteristics of polyolefins such as Paxon™), resisting impacts that would crumple cinderblocks. Also, the structural panels can be made in large segments, which would be impossible for preformed concrete and extremely expensive to duplicate using cinderblock walls. The structural panels are light, and easy to transport, as well as assemble. As a result, substantial savings in labor cost can be achieved when using structures made from the subject structural panel 1. The strength of the structural panels also extends to shear forces, such as those that would be developed by weight resting on the panels when they are used as foundation or basement walls. Further, while concrete and masonry have little strength in tension, the structural panels 1 of the present invention have extremely tensile strength (due to the nature of polyolefin such as Paxon™). As a result, they can be used to provide a high level of earthquake or blast resistance in foundation walls, or the walls of any other structure. Polyolefins are extremely resilient, and can flex without permanent deformation.

A key advantage of the inventive structural panels is that they are virtually impermeable to the migration of moisture, as well as the migration of many gasses (when the adjoining panels are properly welded together). Thus the use of these panels in basement walls is highly desirable since the migration of Radon gas is prevented when the wall panels are properly welded together. The relatively high insulating value of the panels also make them particularly desirable in basement walls, as well as many other types of walls.

Not only can the inventive structural panel 1 of the present invention be used in foundation and basement walls, it can also be used in any structural application where lightweight, high strength, and impermeability to moisture are needed. For example, the inventive structural panels 1 can be used as flooring in situations where moisture is likely to migrate through the floor because of a high water table. The panels of the present invention can be used to construct waterproof chambers when the edges of adjacent panels are properly welded to each other. Another application in which the waterproof panels of the present invention can be used is in the walls of both aboveground and underground swimming pools. Because of the lightness and the strength of the structural panels 1, they can be used in roofing as well as aboveground walls.

Because of the high insulating values of the inventive structural panels 1, they can be used in retrofitting applications to strengthen and waterproof existing foundation walls. The capability of the structural panels 1 to handle shear loads (loads applied on the upper edge of vertically upright panels, such as those occurring when the panels are used in foundation wall applications to support structures resting on the foundation), makes them particularly effective as retrofit reinforcing structures to help support loads on existing walls which have begun to show signs of degradation. The superior qualities of the inventive structural panels 1 make them useful in a much wider variety of applications that can be listed for purposes of disclosing the key components of the present invention.

In order for each structural panel 1 to be waterproof, it must be sealed at its periphery by a plastic layer 4 (as depicted in FIG. 1). Plastic thermal welding is well known, and can be used to seal the edges of the structural panels 1 at the factory where the panels are fabricated, or on the construction site where the panels are put into place in the building. Various types of devices for thermal welding, as well as the materials to be used therewith, are well known in both the plastics and construction industries. Accordingly, no further description of these techniques are necessary for understanding the present invention. The key aspect of the welding process is that panel edges are welded together in order to maintain impermeability to water. The outside or exposed edges of the panels must also always be sealed with plastic in order to prevent the migration of water into the center fiberboard panel 3.

In a first preferred embodiment of the three-layer panel 1, the materials selected include two outer layers of Paxon™ BA, 50-100HMWPE (manufactured by Spartech and Exxon). The middle layer is Foamular®, XPS250 (manufactured by Owens-Corning). To the best understanding of the applicant, Paxon™ has not previously been used as a foundation building material or in combination with other types of material to form a structural panel. The Paxon™ was selected because of particular beneficial characteristics, as described in Appendices A and C. It should be noted that other high-density, high-molecular weight polyethylene materials could be used within the inventive concept depicted in FIG. 1. However, the results may not be as good for such structural panels as they are for structural panels using the Paxon™ material. For this reason, the use of Paxon™ in structural applications, as well as its combination with other materials to form a layered structural panel, constitutes a new use for the Paxon™ material.

In the preferred embodiment using the Paxon™ and Foamular® layers, an optimum range of sizes was selected. For example, those panels that were tested were constituted by a first Paxon™ exterior panel ½ inch thick, in inner layer of Foamular® 2 inches thick, and the second outside layer of Paxon™ ⅜ inches thick. 10 foot by 10 foot constructional panels with this arrangement of layers were then sealed with plastic at all the edges and the beneficial test results as described in Appendix A, were achieved. Other advantages of this specific panel arrangement are described below.

Calculations (Appendix A) based upon the basic, tested characteristics of the Paxon™ and Foamular® materials (including such characteristics as the Young's modulus and the R values as provided by the manufacturers in Appendix C) were used to calculate the structural characteristics of the inventive structural panel 1, with comparison to conventional masonry or poured concrete foundation walls. The aforementioned panel configuration was calculated to be fifty times stronger than a conventional masonry wall (using 8 inch block held by mortar), and thirty times stronger than a poured concrete wall. The aforementioned structural panel, configured as described supra, also has an R value in excess of 11. The outer sheets of Paxon™ are non-biodegradable, and incorporate additives for ultraviolet (UV) stability flame retardency, and colorfastness. As a result, the Paxon™ material is close to 0. Also the two Paxon™ outer layers 2*a*, 2*b*, serve to protect the water sensitive Foamular® inner layer 3, which has a moisture absorption of 3% by volume. The Foamular®, used as the inner layer 3 of the structural panel sandwich 1, is used for its insulating properties, which is a minimum of R5 per inch.

The structural strength and other characteristics of the composite structural panel 1 were calculated since the use of these materials in a composite structural panel has not yet been done due to the novelty of the structure. The calculations needed were based on the information found in the following publications, incorporated here by reference;

1) Hagen, K. D., *Heat Transfers with Applications*, 1999, Prentice-Hall;
2) Cerny, L., *Elementary Statics and Strength of Materials*, 1981, McGraw-Hill;
3) Rodrigues, F., *Principles of Polymer Systems*, 1996, Taylor and Francis;
4) Seymour, W. B., *Modern Plastics Technology*, 1975, Prentice-Hall;
5) Hibbeler, R. C., *Engineering Mechanics Statics*, 1998, Printice-Hall;
6) Lindeburg, M. R., *Engineering-in-Training Reference Manual*, 8$^{th}$ *Edition*, 1992, NSPE.

The aforementioned sources are also used in formulating the calculations for the subject structural panel sandwiches 1 mounted as part of a framework wall, as depicted in FIG. 2, and Appendix B.

In one embodiment of the present invention the structural panel 1 is used as a retrofit device to add insulating properties and moisture stopping properties to existing concrete or masonry walls. This can be done by use of through-bolts holding the structural panel to either a masonry or wooden wall. Once the bolts are in place, the heads of the bolts are sealed by means of plastic welding. The plastic welding can be carried out using a thermal welding device or an ultrasonic welding device. For this type of retrofit to be useful on a masonry wall, the structural panel 1 should be used in conjunction with a plastic membrane placed over the footer supporting the existing masonry wall. Also, it will be necessary to plastic weld all of the seams between the structural panels.

The cross sectional side view of FIG. 2 depicts the preferred embodiment of the invention that has been best explored and analyzed, and is expected to experience the highest commercial use. The arrangement depicted in FIG. 2 is for a basement or foundation wall that is constituted by the structural panel 1 mounted on a stud framework.

One variation of this embodiment is the use of a single one-half inch, high-density Paxon™ (or other high density polyethylene) panel on galvanized steel studs 9. However, a more desirable combination is to mount structural panel 1 (as depicted in FIG. 1) to the steel studs 9 using through-bolts (not shown) for this purpose. It should be noted that other methods of holding the structural panel 1 to the studs can be used. These include plastic welding of the panel to plastic connectors that can be attached in a variety of ways to the steel studs.

It should be noted that while steel studs 9 are preferred for a foundation or basement wall, wooden studs can also be used with the structural panel 1 of FIG. 1 to constitute a foundation wall. However, steel has certain advantages (in strength, flexibility, and connecting techniques) that are not enjoyed by wood. Accordingly, steel is preferred in the commercial embodiment depicted in FIG. 2. Further, steel studs handle thermal creepage better than most other materials.

The foundation wall is arranged on a standard solid concrete footer 100, which is buried in the earth 101 at a depth prescribed by local building codes. Besides being held by connectors (not shown) to structural panel 1, the steel studs 9 are also tied together using steel tracks 9A at the top and the bottom of the studs. The rest of the structure supported by the foundation wall is depicted as being attached to the upper steel track using joist screws 305. The structure 300, supported by the foundation wall, includes joist steel plate 301, rim joist 302, floor joist 306, flooring 303, and wall sill plate 304. This is a standard building arrangement, and any variety of such an arrangements can be used in conjunction with the inventive foundation wall. Because of the strength of the subject foundation wall, a wider variety of structures can be supported thereby, than with conventional masonry walls.

In order to affect a waterproof structure, it is preferable to place a waterproof plastic membrane 6 (preferably polyethylene) under the wall (galvanized steel track 9A), and to bond that membrane to the outer Paxon™ layer (2*a*) using a plastic weld 8. The plastic weld is easily effected at the construction site, using either a thermal or ultrasonic welder and any number of different plastic welding rods to provide the weld material. On the interior of the steel studs 9 a concrete floor (as specified by local building codes) is arranged to overlap the interior portion of the foundation wall, as shown in FIG. 2. Normally, it would be desirable to place interior paneling on the steel studs. However, this is not necessary to achieve the benefits of the present invention.

While a single Paxon™ sheet can be used as the structural panel 1 on the outer service of the studs 9 within the scope of the present invention, it is preferable to use the structural panel 1 as depicted in FIG. 1. This arrangement provides a much higher insulating level due to the Foamular® (or other similar insulating material) R values. Further, in the arrangement depicted in FIG. 2, the second Paxon™ sheet 2(*b*) on the interior side of the structural panel 1 prevents migration of moisture from inside the structure to the moisture-absorbing insulating material 3. Since the permeability to water of the Paxon™ material is virtually zero (10,000 times less permeable to moisture than poured concrete), the center insulating layer 3 is protected on both sides. This protection is rendered complete by the plastic barrier 4 welded onto the periphery of the entire panel.

Despite the strength of the structural panel sandwich of FIG. 1, this is not the primary axial load-bearing element of the foundation wall. Rather the structural steel frame work of 8-inch, 16-gauge steel studs, on 16-inch centers, is the primary support means for the wall system. As depicted in FIG. 2, the studs are enclosed at both ends by 16-gauge, 8-inch steel tracks. The structural wall panel 1 is connected through the studs 9 using self-taping, corrosion-resistant countersunk steel screws 91 at two-foot intervals along the height of the wall. The screw heads are then sealed using plastic thermal welding.

It should be noted that while 8-inch steel studs are used in the embodiment of FIG. 2, other sizes of studs can be applied within the parameters of the present invention. For example, wood or plastic studs can be used. Each type has certain advantages and certain deficiencies when compared to steel studs. Accordingly, the use of different materials will be dictated by the particular application in which an inventive wall system will be placed.

It should also be noted that a wide variance in the thicknesses in both the Paxon™ and Foamular® sheets of structural panel 1 are permitted within the parameters of the present invention. For example, practical thicknesses of the Paxon™ sheet ranges from ⅛ inch to 1 inch, for either the exterior (2*a*) or the interior (2*b*) sheets. The Foamular®, insulating layer 3, is considered to have a practical range between ½ inch and 2 inches when applied to foundation walls. However, the Foamular® could be virtually any thickness that is required, and that can be handled in the sandwich configuration of FIG. 1.

Accordingly, there may be some applications, such as large scale water-retention, that require much greater thicknesses of the Paxon™ panel while requiring lesser thicknesses of the Foamular®. In some cases, the Foamular® may not be needed at all. In other applications, only two layers (one of Paxon™ and one of Foamular®) would be adequate. In other applications, the use of only a single Paxon™ panel would be necessary. Likewise, in some applications, additional panels of the Paxon™ can be applied to the overall wall structure. For example, an additional layer of Paxon™ can be applied to the interior side of the steel studs 7 on the wall of FIG. 2. This would prevent moisture from migrating from the interior of the building into the space between the studs. This could be particularly important if the spaces between the studs are filled with moisture-absorbing insulating material to increase the overall insulating value of the wall in R value greater than 14 (the maximum that can be expected from the example containing 2 inches of Foamular® and ⅞ inches of Paxon™). Conceivably, the steel studs 7 could have the structural panel sandwich of FIG. 1 on both the exterior and interior. This would result in a much stronger (although more expensive) structure with much improved insulating capabilities. Even with such an arrangement, the overall weight of the wall system would be much lighter than a conventional masonry or poured concrete equivalent. As a result, large panels could be fabricated at a factory, moved to the job site, and easily arranged on the footer 100.

The calculations for the strength of individual ⅜ inch and ½ inch Paxon™ panels are found in appendix A, attached hereto. However, individual Paxon™ panels are seldom used in any application in which they are expected to provide structural strength by themselves. Rather the overall behavior of a wall system, such as that depicted in FIG. 2, is important since the interaction of all of the elements in the wall system, and their effects on each other must be fully appreciated to determine how the wall system will behave under various types of stress.

An example for overall system characteristics is provided by the wall system depicted in FIG. 2 where studs are provided every 16 inches and connecting screws are provided for every 2 feet of vertical dimension. The wall is assumed to be 10 feet in height and the weight of the wall itself is negligible for purposes of calculation.

One key aspect for considering the overall strength of the wall is thermal expansion. As part of a consideration of thermal expansion, polymer-softening temperatures should also be considered, in particular in the fitting of the wall system by drilling through holes for the connecting bolts or screws. When handling the tracks and material, the drill bit may get hot due to friction effects, so that thermal effects must be considered. It is important that the flash point or ignition point of the Paxon™ material is not exceeded. It should be noted that this temperature would be considerably higher than the softening temperature. The softening temperatures for the Paxon™ and Foamular® are 254 degrees Fahrenheit and 150 degrees Fahrenheit, respectively. This should not be a problem since if the Paxon™ becomes warm during the drilling process, a slight amount of flow or expansion may occur. However, this would be advantageous, as it would help seal the screw into the panel. If the Foamular® becomes too warm, it would shrink back a little bit and then immediately set again. Thus, structural panel 1 is easily drilled and mounted at a building site.

Warping, "creep," or "flow," caused by temperature extremes, is inhibited by the steel-framing systems (studs 9 and steel tracking 9A). The calculations are found in Appendix A, and are summarized below.

Despite the possible deflection due to a maximum possible force that could occur on a 10 foot by 10 foot Paxon™ sheet, the capabilities of the structural panel 1 are such that the steel supports and the 3-layer design would serve to stabilize and reinforce each of the layers, as well as compensating for any creep or flow. For example, for a 75 degree F. temperature differential (a very large temperature swing for most basement structures) a ½ inch thick 100 square foot panel would exert approximately 5,670 lb. However, the steel framing would easily absorb this force.

The strength of the wall section of FIG. 2 is such that for a 10 foot length, a single Paxon™ sheet could absorb 3.85 * $10^5$ lb., as indicated in the calculations of Appendix A. Further, Paxon™ sheet (½ inch by 1 foot by 3 foot) would have to deflected 87 degrees before it would snap or fail. Consequently, a structural panel such as that depicted in FIG. 1, having two Paxon™ sheets will be capable of withstanding four times the amount of moment capacity as a single sheet before bending. Used with the steel framework of studs 9 and tracks 9A the wall system is even stronger. For example, for a system similar to that depicted in FIG. 2, the capacity of the steel framing without the Paxon™ sheet would be nominally 3 * $10^7$ pounds per square inch. The normal load of a basement wall is usually only 204 pounds per square inch to support itself. The difference in these two values is the capacity to support an overlying structure. Clearly the use of the steel frame with Paxon™ panels of FIG. 1 would provide foundation walls having the capacity to handle a far wider range of structures than is possible with conventional masonry or poured concrete foundation walls.

Another aspect is the strength of the FIG. 2 wall against normal forces (as opposed to sheer forces caused by loads on top of the wall) caused by such side impacts as the weight of the earth against the wall, explosions, earthquakes, water pressure, and the like. To calculate normal strength of the wall, moment calculations are made as indicated in Appendix A. A composite structural panel, such as that depicted in FIG. 1, can withstand a moment of 2 * $10^{10}$ lb. ft. Such a structural panel requires 2400 times the moment necessary to bend a singe Paxon™ panel. As a consequence, studs 9 having 16 inch centers are more than adequate to support such a wall panel from any normally-occurring forces. Because of this strength, and the flexibility of the steel studs, structures made using the foundation wall system depicted in FIG. 2 have substantial earthquake and shockwave resistance.

A crucial aspect of any foundation wall system is the drainage system which takes water away from the wall and prevents water from accumulating at the foot of the wall (the source of most basement leaks). This is normally accomplished with conventional ceramic drainage tiles located in a gravel bed next to the footer supporting the wall. Unfortunately, placement of such tiles is time consuming, and can be erratic if the installer is unskilled. Further, the tiles can be easily separated by normal shifting caused by freezing, water impact, earthquakes, or the like. Compacting the earth next to the tiles (whether by time or the exertion of substantial forces on the ground above the tile) can also dislodge the tiles and prevent proper drainage from the foot of the wall.

The solution included in the foundation wall system of the present invention is an approximately square drainage track 5 that fits along the footer 100, which supports the foundation wall. The drain track is preferably made of polyethylene. However, any similar material can be included within the scope of the present invention. Further, while an approximately square 3-inch by 3-inch drain pipe has been used in tests, other sizes would also fall within the scope of the present invention. The bottom of the drainpipe has a plurality of perforations 52, which accommodate rising ground water so that it can be diverted away from the foundation wall. The top surface of the drainpipe 5 has a sloped surface 51 which prevents water accumulation near the top of the footer.

A ¼ inch polyethylene membrane 6 is attached to drainpipe 5, and configured to fit over the top of the footer and underneath the foundation wall, as depicted in FIGS. 2 and 3B. In the typical model of the inventive foundation wall system, membrane 6 is made up of Paxon™ BA 50/100 polyethylene. However, other materials can be used. Preferably, the membrane 6 is configured for the exact size and shape of the footer so that the footer can be entirely sealed at the top and part of the outer side surface. A polyethylene weld 8 (FIGS. 2 and 4) is used to seal the interface between the lower wall panel 1 and the top of membrane 6. The weld can be made either at the building site or at a factory where drainpipe 5 and membrane 6 are formed as part of large wall sections. The ends of drainpipe 5 and membranes 6 at the edges of wall segments can be joined to adjacent wall segments using standard plastic welding techniques.

FIG. 4 depicts a detailed view of FIG. 2, in particular the details of a conduit system 10, which is arranged in pre-drilled holes in the studs 9. The conduit system 10 is preferably square or rectangular in cross section, containing numerous sectionalized pathways 12 (as depicted in FIG. 5). Conduit system 10 is preferably made of a sturdy plastic, which can be easily sealed at the interfaces of adjacent sections. Through the use of the compartments, specific types of lines can be limited to only certain portions of the conduit system. For example, electrical lines could be in relatively large compartments while separated from cable lines, which would also be in separate large compartments. Telephone lines could be segregated into their own compartments, as would in-house data lines. The compartments 12 of the conduit system 10 are also ideal for handling optical fibers, or any other exotic communications medium.

Any number of aligned pre-formed apertures in the steel studs 9 can be used to accommodate the conduit system 10. Currently, multiple conduit systems can be run through the same wall. It should be noted that compartments in the conduit system can be made large enough to accommodate plastic water lines or air lines for hospital use. The conduits can be located virtually anywhere along the height of the system.

A major difficulty in conventional conduit systems resides at the corners of the walls where heavy electrical cable often has to be pulled through a 90-degree turn. This is extremely difficult and tiresome for the installers. Often, machine assistance is necessary in order to pull the heavy electrical cable through multiple 90-degree turns. This problem is virtually eliminated by the corner piece 11, as depicted in FIG. 5. The corner piece has a 5-inch outer radius and a 3-inch inner radius for a conduit cross-section of 2 inches by 2 inches. However, different sizes can be used while maintaining the concept of the present invention.

While the conduit system 10 can be made of a high-density polyethylene material such as Paxon™, there is no reason to use such a dense and durable material in such as manure. Rather, virtually any type of plastic or similar material can be used to constitute the segments of the conduit system. The key aspect regarding strength is that the corner units be capable of withstanding the pressures cause by pulling heavy electrical cable through them. However, it should be noted that many of the pressures generated as a result of conventional 90-degree turns have been eliminated by the curved configuration of corner unit 11 of the present invention. As a result, a great deal of saving can probably be achieved by making the conduit system of a far lighter, less expensive material than is required by the rigors of conventional conduit-pulling.

While a number of embodiments have been disclosed by way of example, the present invention is not meant to be limited thereto. Accordingly, the present invention should be understood to include any and all variations, modifications, permutations, adaptations, derivations, and embodiments that would occur to an individual skilled in this technology, once having been taught the invention by the present application. Thus, the present invention should be limited only in accordance with the following claims.

I claim:

1. A foundation wall system comprising:

a framework; and a plurality of panels connected with said framework, each one of said panels of said plurality of panels including an inner layer disposed between first and second outer layers formed of sheets of polymeric material, said inner layer being formed of an insulating material, said first and second outer layers being impermeable by water, each one of said panels of said plurality of panels includes a seal which blocks access of water to said inner layer and is formed by thermal welding of polymeric material along at least one peripheral edge portion of said one panel, said seal includes a strip of polymeric material which is impermeable by water and spans said inner layer, said strip of polymeric material is formed separately from said first and second outer layers and is thermally welded to said first and second outer layers.

2. A foundation wall system as set forth in claim 1 wherein said framework includes a plurality of spaced apart studs, each panel of said plurality of panels being connected with said plurality of said studs and spanning open spaces between said plurality of said studs.

3. A foundation wall system as set forth in claim 1 wherein said first outer layer of a first panel of said plurality of panels is thermally welded to a first outer layer of a second panel of said plurality of panels to form a water impermeable joint between said first and second panels.

4. a foundation wall system as set forth in claim 1 further including a membrane of polymeric material extending beneath said framework and beneath a lower peripheral edge portion of at least one panel of said plurality of panels, said membrane being thermally welded to said lower peripheral edge portion of said one panel.

5. A foundation wall system as set forth in claim 1 further including a concrete footer, a membrane formed of polymeric material and disposed over said concrete footer, said framework being disposed over said membrane, and at least one thermal weld connecting said membrane with at least one of said panels.

6. A foundation wall system as set forth in claim 5 further including a drainage track disposed along said concrete footer, said membrane extends over at least a portion of said drainage track.

7. A foundation wall system comprising:

a framework;

a plurality of panels connected with said framework, each one of said panels of said plurality of panels including an inner layer disposed between first and second outer layers formed of sheets of polymeric material, said inner layer being formed of an insulating material, said first and second outer layers being impermeable by water; and a membrane of polymeric material extending beneath said framework and beneath a lower peripheral edge portion of at least one panel of said plurality of panels, said membrane being connected by a seal to said lower peripheral edge portion of said one panel.

8. A foundation wall system as set forth in claim 7 wherein said first outer layer of a first panel of said plurality of panels is thermally welded to a first outer layer of a second panel of said plurality of panels to form a water impermeable joint between said first and second panels.

9. A foundation wall system as set forth in claim 7 further including a plurality of fasteners extending through said panels into said framework to connect said panels with said framework and a plurality of seals which block access of water to said inner layer of said panels along said fasteners and are formed by thermal welding of polymeric material at said panels.

10. A foundation wall system as set forth in claim 7 wherein said first and second outer layers of each of said panels are each formed of a high molecular weight, high density polyethylene.

11. A foundation wall system as set forth in claim 7 wherein said seal includes a strip of polymeric material which is impermeable by water and spans said inner layer, said strip of polymeric material is thermally welded to at least said first outer layer.

12. A foundation wall system as set forth in claim 11 wherein said strip of polymeric material is thermally welded to said second outer layer.

13. A foundation wall system as set forth in claim 12 wherein said strip of polymeric material is formed separately from said first and second outer layers.

14. A foundation wall system as set forth in claim 7 further including a concrete footer, said membrane being disposed over said concrete footer.

15. A foundation wall system as set forth in claim 7 further including a drainage track, said membrane extends over at least a portion of said drainage track.

16. A foundation wall system comprising;

a concrete footer;

a drainage track extending along said concrete footer;

a membrane formed of a polymeric material disposed over at least a portion of said concrete footer and over at least a portion of said drainage track;

a steel framework disposed over and connected with said concrete footer with a portion of said membrane being disposed between said concrete footer and said steel framework;

a plurality of panels connected with said steel framework, a first panel of said plurality of panels including an inner layer of insulating material disposed between first and second outer layers formed of sheets of polymeric material; and a seal connecting an edge portion of said first outer layer of said first panel to said membrane to form a water impermeable joint between said first panel and said membrane; said seal being formed by a thermal weld which interconnects said first panel and said membrane.

17. A foundation wall system comprising:

a framework;

a plurality of panels connected with said framework, each one of said panels of said plurality of panels including an inner layer disposed between first and second outer layers formed of sheets of polymeric material, said inner layer being formed of an insulating material, said first and second outer layers being impermeable by water, and a strip which extends from said first outer layer across said inner layer to said second outer layer, said strip being thermally welded to said second outer layer and being effective to block access of water to said inner layer; and a membrane of polymeric material extending beneath said framework and beneath a lower peripheral edge portion of at least one panel of said plurality of panels, said membrane being thermally welded to said lower peripheral edge portion of said one panel.

* * * * *